US006857860B1

(12) United States Patent
Zimmermann et al.

(10) Patent No.: US 6,857,860 B1
(45) Date of Patent: Feb. 22, 2005

(54) METERING PUMP FOR LIQUID PRODUCTS

(75) Inventors: Philippe Zimmermann, Reconvillier (CH); Joseph Ruegg, Tavannes (CH)

(73) Assignee: Pomtava SA, Reconvilier (CH)

( * ) Notice: Subject to any disclaimer, the term of this patent is extended or adjusted under 35 U.S.C. 154(b) by 0 days.

(21) Appl. No.: 10/258,632

(22) PCT Filed: May 8, 2000

(86) PCT No.: PCT/CH00/00255

§ 371 (c)(1),
(2), (4) Date: Oct. 24, 2002

(87) PCT Pub. No.: WO01/86150

PCT Pub. Date: Nov. 15, 2001

(51) Int. Cl.[7] ..... F04B 17/00; F04B 23/00; F04B 35/00; F01C 1/18; F01C 19/00

(52) U.S. Cl. ..... 417/410.4; 417/319; 417/313; 417/360; 418/206.1; 418/206.6; 418/104

(58) Field of Search ..... 418/206.1, 206.6, 418/104; 417/313, 319, 360, 362, 410.3, 410.4

(56) References Cited

U.S. PATENT DOCUMENTS

| | | | | | |
|---|---|---|---|---|---|
| 2,649,740 | A | * | 8/1953 | Murray et al. | 418/39 |
| 3,133,506 | A | * | 5/1964 | Luciani | 418/91 |
| 3,286,643 | A | * | 11/1966 | Andrews et al. | 418/78 |
| 3,881,849 | A | * | 5/1975 | Commarmot et al. | 418/182 |
| 4,515,512 | A | | 5/1985 | Hertell et al. | 418/1 |
| 4,699,575 | A | * | 10/1987 | Geisel et al. | 418/104 |
| 4,737,087 | A | * | 4/1988 | Hertell | 418/1 |
| 4,856,427 | A | | 8/1989 | Gasparrini | 101/366 |
| 5,168,905 | A | * | 12/1992 | Phallen | 141/1 |
| 5,244,367 | A | | 9/1993 | Aslin | 418/104 |
| 5,391,068 | A | * | 2/1995 | Uppal | 418/206.1 |
| 5,797,520 | A | * | 8/1998 | Donahue | 222/386.5 |
| 5,890,656 | A | * | 4/1999 | Fuhlbrigge | 239/227 |

FOREIGN PATENT DOCUMENTS

| | | | | |
|---|---|---|---|---|
| DE | 1403912 | | 1/1969 | |
| DE | 3903195 | | 8/1990 | |
| JP | 04-41984 | * | 6/1990 | F04C/2/18 |
| JP | 04041984 | | 2/1992 | |

* cited by examiner

*Primary Examiner*—Cheryl J. Tyler
*Assistant Examiner*—Timothy P. Solak
(74) *Attorney, Agent, or Firm*—Pearne & Gordon LLP

(57) ABSTRACT

The invention concerns a metering gear pump comprising a set of gears supported and guided solely by the inner peripheral surface of the lobe of the chamber wherein they are housed. They do not comprise any shaft to act as support or guide, thereby enabling to reduce significantly useless spaced difficult to rinse when changing the product to be pumped. For the same purpose, the driving shaft is flexibly connected to the driving gear. Such arrangement provides the advantage of requiring only one single packing seal. Such a pump, connected to a drive motor and an encoder delivering a signal proportional to the number of pump cycles, enables to provide an accurate metering pump for numerous uses.

11 Claims, 2 Drawing Sheets

METERING PUMP FOR LIQUID PRODUCTS

BACKGROUND OF THE INVENTION

The present invention concerns a metering pump for liquid products.

PRIOR ART

Notably two types of devices for precision metering of liquid products are known, viz., the motorized gear pump and the flowmeter with flow rate controller. These two types of devices have problems, particularly when there is a need for rather rapid change of the liquid product being metered, as for instance in robotized installations for car body painting. It is necessary, in fact, when the product to be metered is rapidly changed, that the metering device is able to be rapidly and easily rinsed in such a way that during metering of a given product not a particle of the previous product be left in the metering device. The two known types of devices have problems of rinsing caused by difficult access for the rinsing or cleaning product or by idle spaces where the product to be eliminated may persist as a film or lump. On the other hand, rinsing that is not optimized will lead to a larger consumption of the product as well as to a longer duration of acceptable rinsing.

It is generally admitted that the gear pump represents the more reliable and more precise metering device, but is also the metering device that is more difficult to rinse in an appropriate manner. A gear pump of the type considered here comprises at least one driving gear and one driven gear, said gears each being held on a shaft mounted on bearings located in the pump body. These bearings give rise to idle spaces difficult to rinse and apt to retain pumped product that is degraded, crystallized or hardened. One way to avoid such idle spaces is that of arranging packing seals on each bearing, which means a minimum of four packings per pump. These packing seals are expensive, generally require some maintenance, and are always susceptible to leak.

The document JP 04 041 984 describes a gear pump in which the two gears are guided by the outer peripheral surface of friction teeth sliding on an inner peripheral surface of the pump chamber. While the problems mentioned above are partly eliminated by elimination of the gear shafts, the driving gear of this device is set in rotation by a shaft that is rigidly mounted. This has the particular disadvantage of dictating the lateral position of the driving gear, which necessitates a larger pump chamber and hence additional idle lateral spaces that are difficult to rinse.

The patent FR 2 163 935 describes a gear pump in which the driving gear is rotated by a driving shaft fixed in a manner to transmit only a rotation torque, the driven gear comprising no support shaft. The driving shaft of this pump does not comprise a packing seal, the sealing being made by a layer of the pumped liquid. Such disposition does not facilitate the rinsing of the pump and causes difficulties to use in the case of frequent changes of the pumped liquid.

The packing described in DE 14 03 912 can under no circumstances be suitable for a pump as proposed here, as it is adapted to a pump having the driving heat rigidly fixed to the driving shaft, being disposed between two bearings supporting the driving shaft.

It is a first aim of the invention, therefore, to propose a metering pump for liquid products improved over known metering pumps.

It is a further aim of the invention to propose a metering pump having a rinsability distinctly improved over that of known pumps.

Still another aim is that of proposing a metering pump that is able to meter a volume of liquid in precise manner.

These different aims are attained by a metering pump for liquid products having the characteristics disclosed herein.

BRIEF DESCRIPTION OF THE DRAWINGS

A preferential embodiment of a metering pump for liquid products is described below, the description to be considered while referring to the annexed drawing comprising the figures in which.

DESCRIPTION OF THE PREFERRED EMBODIMENT

Figure 1:
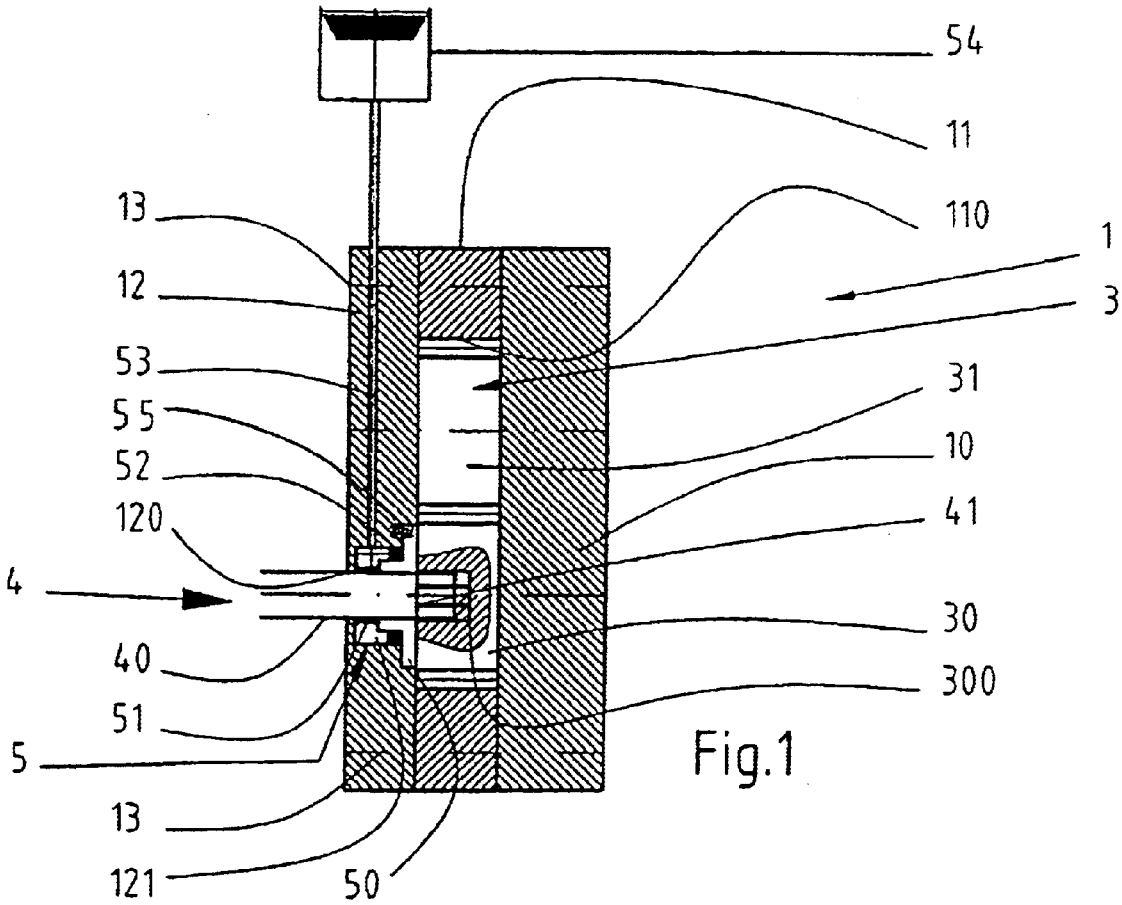
FIG. 1 presents a lateral view along a first section of a metering pump for liquid products according to the invention.

FIG. 1 shows that the body 1 of the pump comprises a bottom plate 10, an intermediate plate 11 and a front plate 12, these three plates here having an essentially rectangular external shape and similar dimensions, which are superimposed as can be seen in the figure. Means of attachment schematically shown at 13 hold these three plates assembled. A seal not shown in the figure secures tight sealing of the contacting faces of these three plates.

Figure 2:
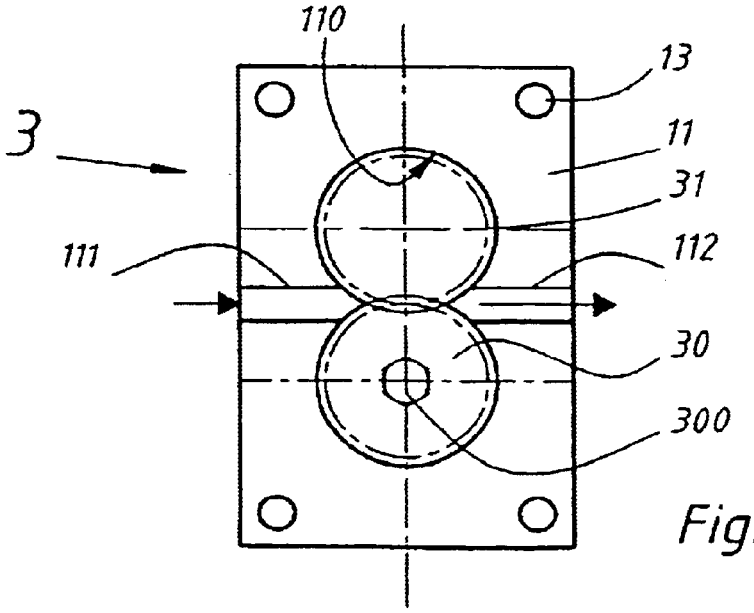
FIG. 2 presents the same pump along a section in a plane perpendicular to the plane of the section of the preceding figure.

The intermediate plate 11 seen in elevation in FIG. 2 essentially consists of a plate, rectangular in this embodiment, which comprises a chamber 110 consisting of at least two lobes each able to receive a gear 30, 31 of a set of gears 3. One can see in FIG. 1 that in the embodiment of the pump represented, chamber 110 reaches entirely across the intermediate plate 1. The intermediate plate 11 additionally comprises an entry channel 111 for liquid that ends in the chamber 110, as well as an exit channel 112 for liquid that leaves said chamber. The openings of these channels can each be arranged on one of the lateral walls of the intermediate plate 11, as shown here, or channels 111 and/or 112 may be extended into either the bottom plate 10 or the front plate 12 while their openings would be located on a periphery of these plates.

The pump additionally comprises a set of gears 3 comprising a driving gear 30 and at least one driven gear 31 as well as drive organs 4 and packing seal 5.

The drive organ 4 comprises a motorized organ not represented in this figure which ends in a drive shaft 40 that goes through a bearing 120 set in the front plate 12. The bearing 120 can be a sliding bearing as shown here or a roller bearing. The end 41 of shaft 40 has a shape such that it can be introduced into a recess 300 of the gear 30 of corresponding shape so that it will be able to rotate said gear. In the case represented here, the end 41 and the recess 300 are both hexagonal, but any other shape allowing a rotating drive could be suitable.

One notices in the figure that the gears 30 and 31 are not supported by any shaft, they are guided while rotating, solely by the outer peripheral surface of the teeth in sliding contact on the inner periphery of the lobes of chamber 10. The lubrication of the surfaces moving relative to each other is assured by the product being pumped. The shaft 40 that is flexibly connected with the driving gear 30 at its end 41 only serves to drive said gear while being without any support or guiding function. The shaft 40 or its end 41 can hence only transmit a torque to the driving gear 30 while any other force in whatever direction is excluded. Since the gears 30 and 31 are no longer guided laterally by a shaft, they can now settle laterally under the effect of pressure of the product being pumped, which acts on their sides. It is thus possible to have a lateral space to both sides of each gear that is as small as feasible, provided a thin sheet of the pressurized product is present that will secure lateral centering of the gear in its lobe. In this way the hollow spaces which would have to be rinsed between two products being pumped are strongly diminished, and only a single set of packing seals 5 has to be fixed on the shaft 40.

In known manner, the packing seal 5 can consist of packings, of lip seals or, as shown here, of a mechanical lining. The mechanical lining has the advantage over other known types of packing seals, of exhibiting the smallest frictional force in rotation. Therefore, preferably a mechanical packing is selected which consists of a sealing ring 50 freely mounted around the shaft 40 and able to move axially in a recess 121 in bearing 120 while being pressed against the front side of gear 30 by an elastic organ, for instance a spring 51, in order to mechanically secure a tight seal between the chamber 110 and the shaft 40. An O-ring 52 serves as a static sealing barrier in the rear of the sealing ring 50. Means represented in the figure at 55 allow rotation of the sealing ring to be prevented. Relative to known designs, that of the packing seal 5 here described allows the sealing barrier to be as close as possible to the end 41 of shaft 40, which substantially contributes to a reduction of the hollow spaces that must be rinsed between two products being pumped. It has been mentioned before that the gear 30 was positioned laterally by the equilibrium of the pressures being exerted on its two sides. Since the side of gear 30 that is linked as described to the shaft 40 is lower than the opposite side, gear 30 would tend to be pressed against the inside of the front plate 12. The elastic organs 51 will therefore be of a size such that they exert a force able to compensate the difference between the opposing forces being exerted on the two opposite sides of gear 30.

Optionally, the packing seal 5 described above is made more complete by a supply 53 of a packing liquid coming from an external reservoir 54. The packing liquid fills the part of recess 121 on the side of O-ring 52 that is opposite to that in contact with the liquid being pumped, and thus exerts a counterpressure on this seal so that its sealing will be improved. A leak of packing liquid in the direction of chamber 110 or a leak of pumped liquid across the seal 52 would lead to a change in level of the packing liquid in the reservoir 54. By monitoring this level it is therefore possible to detect liquid leaks at the packing seal in any one direction. The presence of a packing liquid in the hollow parts of recess 121 also prevents a condensation and crystallization of the pump ed liquid in these hollow parts.

The gear metering pump as described above is thus optimized so as to substantially improve its rinsability, by eliminating the hollow spaces to be rinsed between two different p products being pumped d, which leads to savings of both the rinsing product and rinsing time. The simplified pump design which uses a smaller number of pump components and requires just a single packing seal reduces by as much the manufacturing cost as well as the risk of leaks, and improves its reliability.

Figure 3:
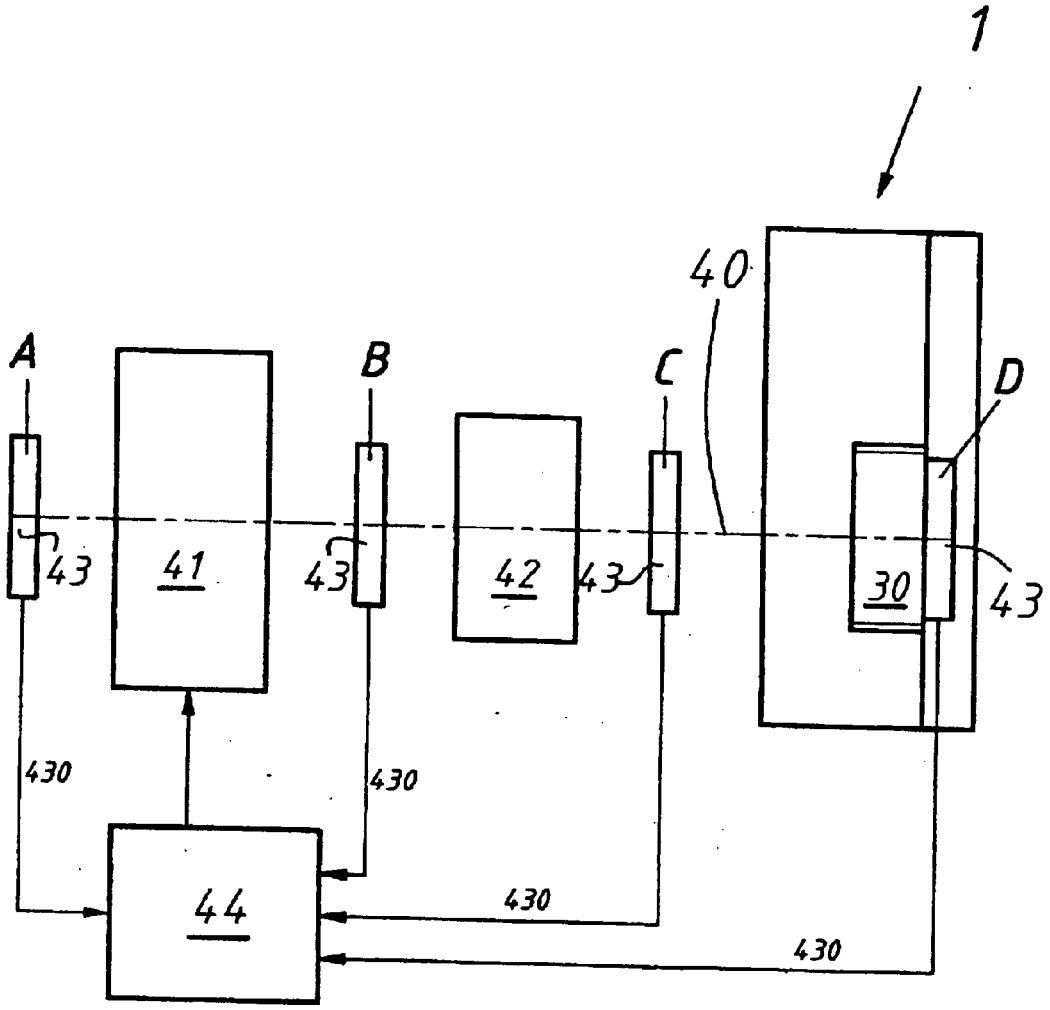
FIG. 3 presents the constituent elements of a metering pump in a schematic way.

The above pump can advantageously be used to meter a product being pumped, the volume of product pumped being essentially proportional to the number of revolutions of gear 30 or 31. By monitoring this number of revolutions it is possible, therefore, to obtain a precision metering pump. Such a pump is presented schematically in FIG. 3.

One recognizes in this figure the pump body 1 with the driving gear 30 being driven by the shaft 40 as described previously. The other end of shaft 40 is driven by a motor 41, which preferably is an electric motor but can also be a pneumatic or hydraulic motor or a motor of any other known type able to drive the shaft 40. A reducing gear or gear box 42 can be arranged on the shaft 40 between the motor 41 and the pump. The rotating speed of gears 30 and 31 of the pump or the volume of liquid pumped are thus equal or proportional to the number of revolutions of shaft 40 as well as of motor 41. An encoder 43 able to record this number of revolutions can thus send a control signal to a control unit 44, for instance an electronic unit containing or not containing a programmed microprocessor and able to record this signal and regulate the pumping process, e.g., by cutting the power supply to the motor 41 when the desired quantity of product has been pumped. The encoder can be arranged at the end of the shaft on motor 41, as shown schematically by the encoder 43 in position A, on shaft 40 in front of or behind the reducing gear 42, if present, as shown schematically in positions B and C, or in the pump itself, as shown schematically at position D. The encoder 43 is of any known type, optical, inductive, capacitive or other, that is able to record the number of revolutions of the motor 41, of the shaft 40 or of one of the gears 30 or 31, depending on the position (A, B, C, D) where it has been installed.

The design of the metering pump can be compact, with the motor 41 being directly glued to the pump body 1, or more distributed, with a shaft 40 that consists of a flexible drive shaft. Such a pump is advantageously mounted on a robotic painting arm, for instance in the painting of car bodies, where the pump together with its drive motor can be located in the mobile part of the robotic arm or, if one wants to minimize the moving masses, the motor 41 can be housed in a part of the base of the robotic arm while the pump body can be located in the mobile end of the arm, while the two elements are linked by a flexible shaft 40. A distributed design with flexible or rigid drive shaft 40 can also be used in order to obtain an explosion-proof pump where the motor 41 that might produce sparks can be remote from the pump body I that could be located in an explosive atmosphere.

In each of the possible applications of such a metering pump, it will be determined by the application considered whether or not a reducing gear or gear box 42 are incorporated, and where the encoder 43 will be placed among any of the positions described above.

The modular design described allows such a metering pump to be employed in numerous applications, painting, metering of chemical products, food products, pharmaceuticals, etc.

The constituent elements of the pump body 1 as well as the gears 3 and the packing seal 5 are made of materials which essentially are compatible with the products being pumped, and which can be metals or alloys, for instance stainless steel, synthetic materials, or ceramics, and these materials may be uncoated or coated with a protecting layer. It is not necessary that the different constituent elements of the pump be made of the same material.

A variety of different versions can be envisaged for the design of a gear metering pump according to the invention. The pump has been described as having one driving gear and one driven gear; it could just as well comprise a number of driven gears arranged along the periphery of a driving gear. The chamber of the pump body would then have the number of lobes required to receive one gear each. The pump body has been described as consisting of three assembled plates, so as to facilitate machining of the chamber 110 of the intermediate plate. It would also be possible for the intermediate plate 11 to be made as a single piece together either with the bottom plate 10 or the front plate 12. Also, the pump body 1 has been described as being of rectangular shape, but it actually could have whatever shape able to accommodate a pumping chamber such as that described. On the other hand, the metering pump has been described as comprising an electric motor and an encoder, in particular. These two elements could be replaced by a step motor, where the number of steps to be executed is determined by the volume of product to be pumped.

What is claimed is:

1. A gear metering pump comprising a pump body with a chamber comprising at least two intersecting cylindrical lobes, a first lobe receiving a driving gear and at least one other lobe receiving a driven gear, said gears being supported solely by their outer periphery leaning against an inner peripheral surface of each lobe, the driving gear being rotated by a drive shaft, an end of which is introduced into an axial recess of said driving gear, while the shape of said end of the shaft cooperates with the shape of said axial recess so as to furnish a drive torque to said driving gear while the drive shaft constitutes no means of radial or axial support or guidance at all between it and the driving gear, a packing seal mounted on the drive shaft, said packing seal being positioned on a surface of a front plate of the pump body that is turned toward the driving gear, in the immediate vicinity of the end of said shaft.

2. A metering pump according to claim 1, wherein the packing seal comprises a mechanical gasketing comprising a sleeve arranged in a recess that is coaxial to the drive shaft, said sleeve being pressed by elastic organs against part of a side of the driving gear, said packing seal comprising means able to prevent rotation of the sleeve, and said sleeve holding an O-ring securing the tight sealing of said coaxial recess.

3. A metering pump according to claim 2, wherein the elastic organs are of a size such that an axial force transmitted by the sleeve is exerted on the driving gear which is able to counterbalance the axial force in the opposite direction that arises from the difference between the sides of the driving gear on which the pressure of the product being pumped is exerted.

4. A metering pump according to claim 2, including a supply of a packing liquid entering said coaxial recess from the side of the O-ring that is opposite to the side facing the driving gear.

5. A metering pump according to claim 1, associated with an encoding device able to supply a signal that is proportional to the number of revolutions made by one of the gears of the pump.

6. A metering pump according to claim 5, wherein said signal is sent to a control unit able to regulate the pumping process according to the signal received.

7. A metering pump according to claim 1, wherein it is associated with a motor able to rotate said drive shaft.

8. A metering pump according to claim 7, wherein the drive shaft is a flexible shaft.

9. A metering pump according to claim 1, wherein it is associated with a robotic arm comprising in particular a fixed base part and a mobile arm.

10. A metering pump according to claim 9, wherein said metering pump is associated with a motor able to rotate said drive shaft, the pump body and the motor are mounted on said mobile arm of the robotic arm.

11. A metering pump according to claim 9, wherein said metering pump is associated with a motor able to rotate said drive shaft, the pump body being mounted on the mobile arm while the motor is mounted on the base part of the robotic arm.

* * * * *